US007070064B1

(12) United States Patent
Henry et al.

(10) Patent No.: US 7,070,064 B1
(45) Date of Patent: Jul. 4, 2006

(54) HANDS-FREE TRASH BARREL LID OPENER

(76) Inventors: Michael L. Henry, 434 Circlewood Dr., Paradise, CA (US) 95969; Lee L. Henry, 1154 Via Jose, San Jose, CA (US) 95120

( * ) Notice: Subject to any disclaimer, the term of this patent is extended or adjusted under 35 U.S.C. 154(b) by 80 days.

(21) Appl. No.: 10/844,789

(22) Filed: May 12, 2004

(51) Int. Cl.
*B65D 43/26* (2006.01)

(52) U.S. Cl. ..... 220/262; 220/908; 248/147

(58) Field of Classification Search ..... 220/262, 220/263, 264, 266, 260, 908; 248/147
See application file for complete search history.

(56) References Cited

U.S. PATENT DOCUMENTS

| | | | | | |
|---|---|---|---|---|---|
| 962,874 | A | * | 6/1910 | Amberson | 248/147 |
| 1,131,774 | A | * | 3/1915 | Davis | 248/147 |
| 1,218,632 | A | * | 3/1917 | Derry | 220/630 |
| 1,247,058 | A | * | 11/1917 | Zifferrer | 248/147 |
| 1,277,099 | A | * | 8/1918 | McNutt | 220/264 |
| 1,704,906 | A | * | 3/1929 | Trick | 220/264 |
| 2,470,271 | A | * | 5/1949 | Steinbacher | 248/97 |
| 2,527,449 | A | * | 10/1950 | Poole et al. | 220/264 |
| 5,230,525 | A | * | 7/1993 | Delmerico et al. | 280/47.131 |
| 5,895,191 | A | * | 4/1999 | Bonora et al. | 414/217 |

FOREIGN PATENT DOCUMENTS

| | | | | |
|---|---|---|---|---|
| DE | 3304327 | * | 8/1984 | 220/264 |
| DE | 3701270 | * | 9/1987 | 220/264 |
| WO | WO 93/17942 | * | 9/1993 | 220/264 |

* cited by examiner

*Primary Examiner*—Lien M. Ngo
(74) *Attorney, Agent, or Firm*—The Kline Law Firm

(57) ABSTRACT

A hands-free trash barrel lid opener utilizes an actuating mechanism that is secured at the lower end of the trash barrel. A mounting means affixes the actuating mechanism to the lower end of the trash barrel. Connecting cables run along the outside of the barrel to connect the actuating mechanism to a lid control mechanism that is affixed to the trash barrel lid. The lid control mechanism includes leverage arms that receive the ends of the connecting cables. A stabilizing bar that is positioned at the back of the trash barrel includes a counterbalance means, typically a spring, that urges the lid of the trash barrel back to a closed position when the actuating lever is released. The opener is constructed so that it can remain in position when the trash barrel is lifted by mechanical arms on a garbage truck.

17 Claims, 5 Drawing Sheets

HANDS-FREE TRASH BARREL LID OPENER

BACKGROUND OF THE INVENTION

1. Field of the Invention

The present invention relates generally to means for easily emptying containers, and more particularly is a device that enables a user to open a trash, recycle, or yard waste barrel with a hinged lid without using his hands.

2. Description of the Prior Art

Most urban trash collection services have moved to the utilization of trash, recycle, or yard waste barrel barrels or garbage cans that are designed to be automatically emptied. In order to be automatically emptied, the barrels must have a hinged lid that swings open when the barrel is inverted. This enables the trash collection service to empty the barrel by raising the barrel above the garbage truck, typically with a hydraulic lifter, and inverting the barrel so that the lid swings open and the contents are spilled into the truck.

While this construction greatly eases emptying of the trash barrels, the larger containers have large, heavy lids that can make access to the interior of the container somewhat difficult. This difficulty is compounded when a user has both hands full of items that are to be deposited in the trash receptacle. Accordingly, devices that assist in opening the lid to a trash barrel have utility to many users.

One such device is the "Leg Operated Trash Barrel Lid Controller" of Armor, U.S. Pat. No. 6,039,200, issued Mar. 21, 2000. This device provides a mechanism that allows the user to apply force by stepping downward on the actuating lever of the device. Vertical push rods are temporarily attached to the lid of the barrel so that the lid is lifted when the actuating lever is depressed. This device is effective in providing easier access to the trash barrel. However, a significant drawback is that the Armor device must be removed from the trash barrel before the barrel can be emptied. The Armor device is designed to be placed in position on an empty receptacle, and removed when the receptacle is filled.

Removal of the Armor device from the receptacle is required to provide access to the automatic emptying equipment.

Accordingly, it is an object of the present invention to provide a device that allows hands-free opening of the lid of a large trash barrel.

It is another object of the present invention to provide a device that can remain installed on the barrel when the barrel is emptied by an automated emptying device.

It is still another object of the present invention to provide a mechanism that greatly reduces the amount of force required to be exerted by the user to raise the lid of the trash barrel.

SUMMARY OF THE INVENTION

The present invention is a hands-free trash barrel lid opener. The device comprises an actuating mechanism that is secured at the lower end of the trash barrel. A mounting means affixes the actuating mechanism to the lower end of the trash barrel. Connecting cables run along the outside of the barrel to connect the actuating mechanism to a lid control mechanism that is affixed to the trash barrel lid. The lid control mechanism includes leverage arms that receive the ends of the connecting cables. A stabilizing bar that is positioned at the back of the trash barrel includes a counterbalance means, typically a spring, that urges the lid of the trash barrel back to a closed position when the actuating lever is released.

An advantage of the present invention is that it enables a user to open a trash barrel lid without using his hands, thereby providing convenience and allowing the user to avoid touching the germ laden lid.

Another advantage of the present invention is that the device can be left in place when the trash barrel is emptied by an automated mechanical lifter on a garbage truck.

A still further advantage of the present invention is that the rear portion of the mounting bracket of the actuating mechanism can be used as a "kicker", making the trash barrel easier to roll, and the side bars of the mounting bracket protect the wheels of the trash barrel.

Yet another advantage of the present invention is that it can be installed on the trash barrel without modifying the trash barrel in any way. No screws or bolts are required.

Still another advantage of the present invention is that it provides mechanical advantage, so that very little force is required to lift the lid.

These and other objects and advantages of the present invention will become apparent to those skilled in the art in view of the description of the best presently known mode of carrying out the invention as described herein and as illustrated in the drawings.

DETAILED DESCRIPTION OF THE INVENTION

Figure 1:
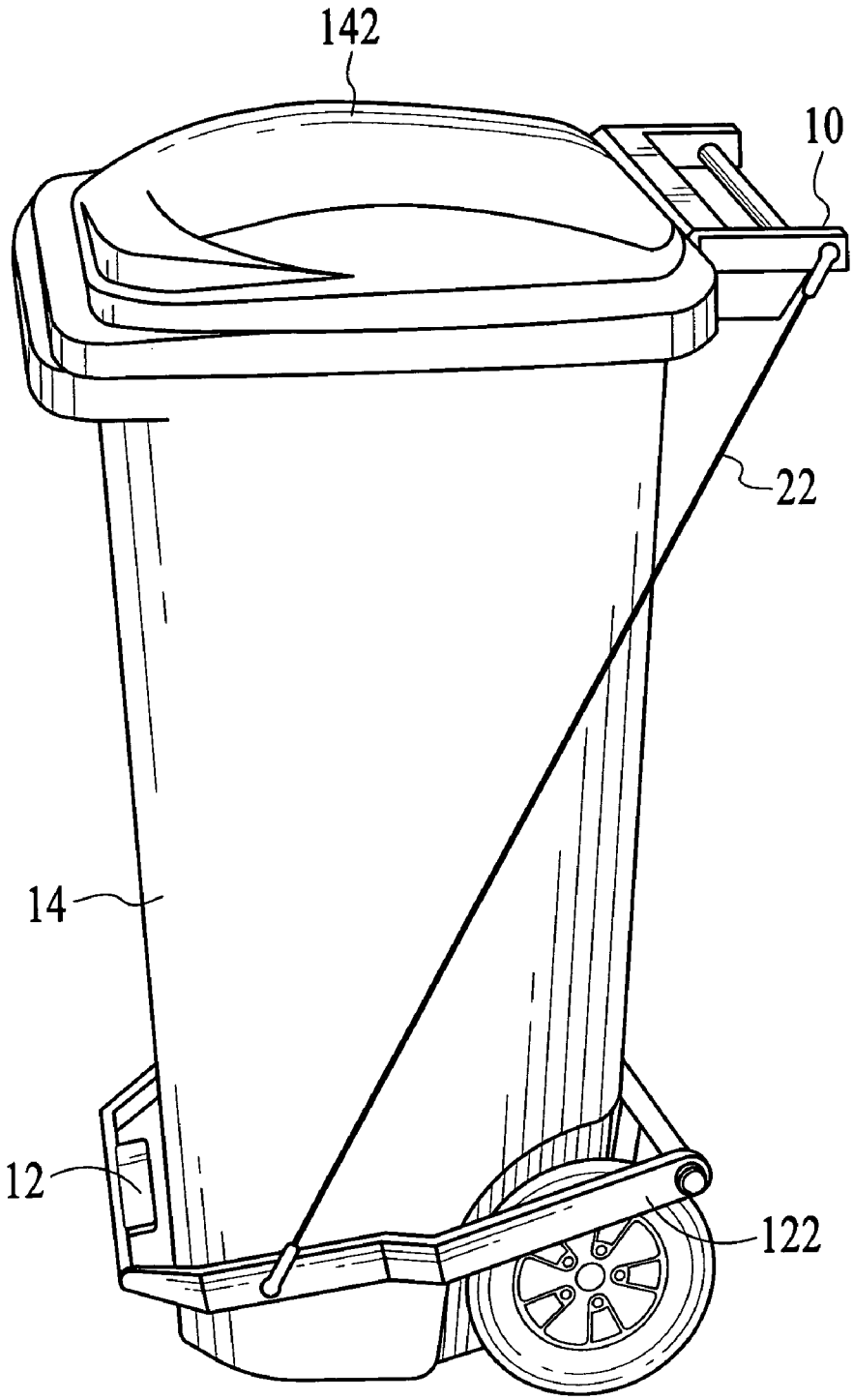
FIG. 1 is a perspective view of the hands-free trash barrel lid opener of the present invention installed on a typical trash barrel.
Figure 2:
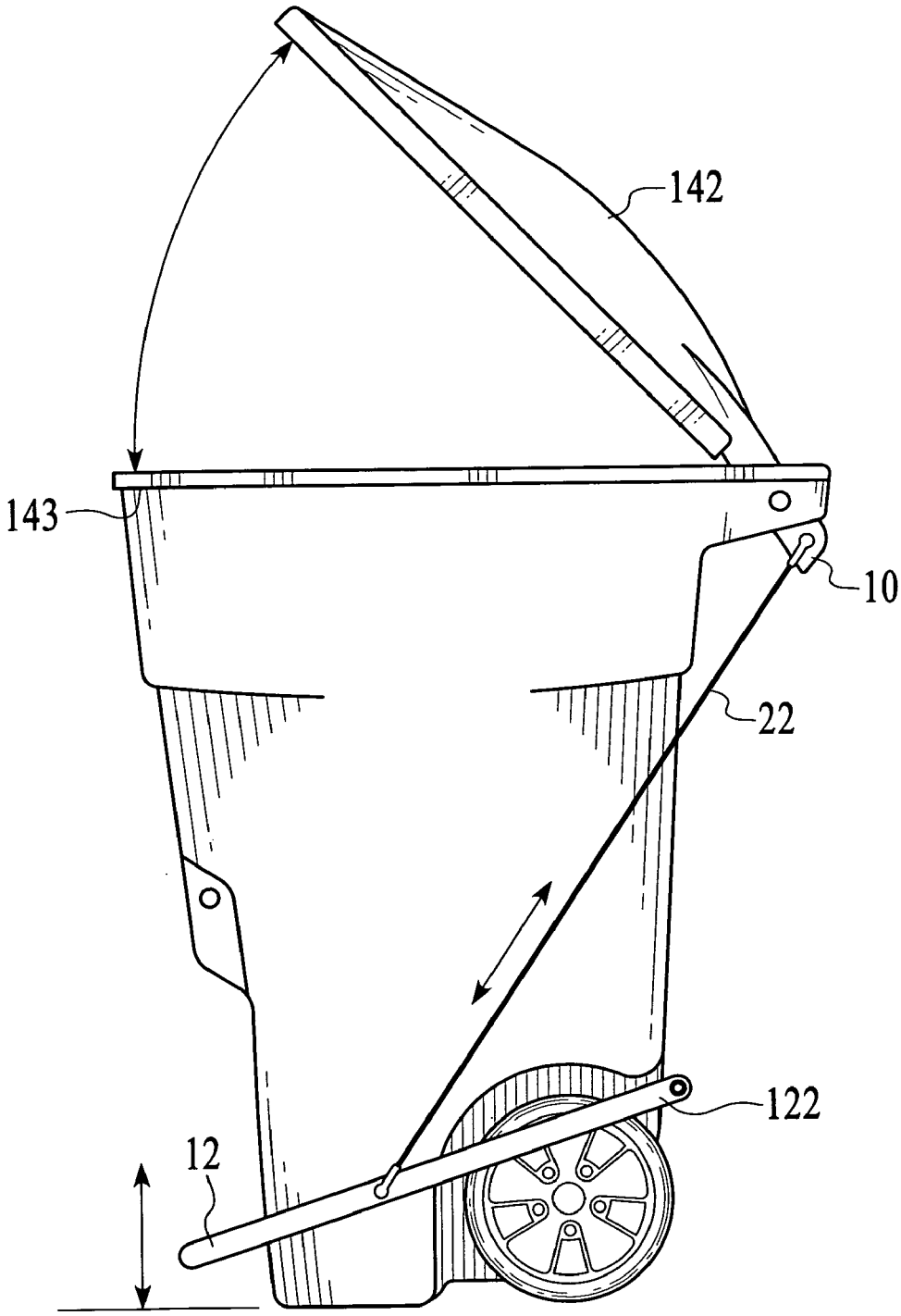
FIG. 2 shows the lid opener installed on a different type of barrel, and with the lid in the open position.
Figure 3:
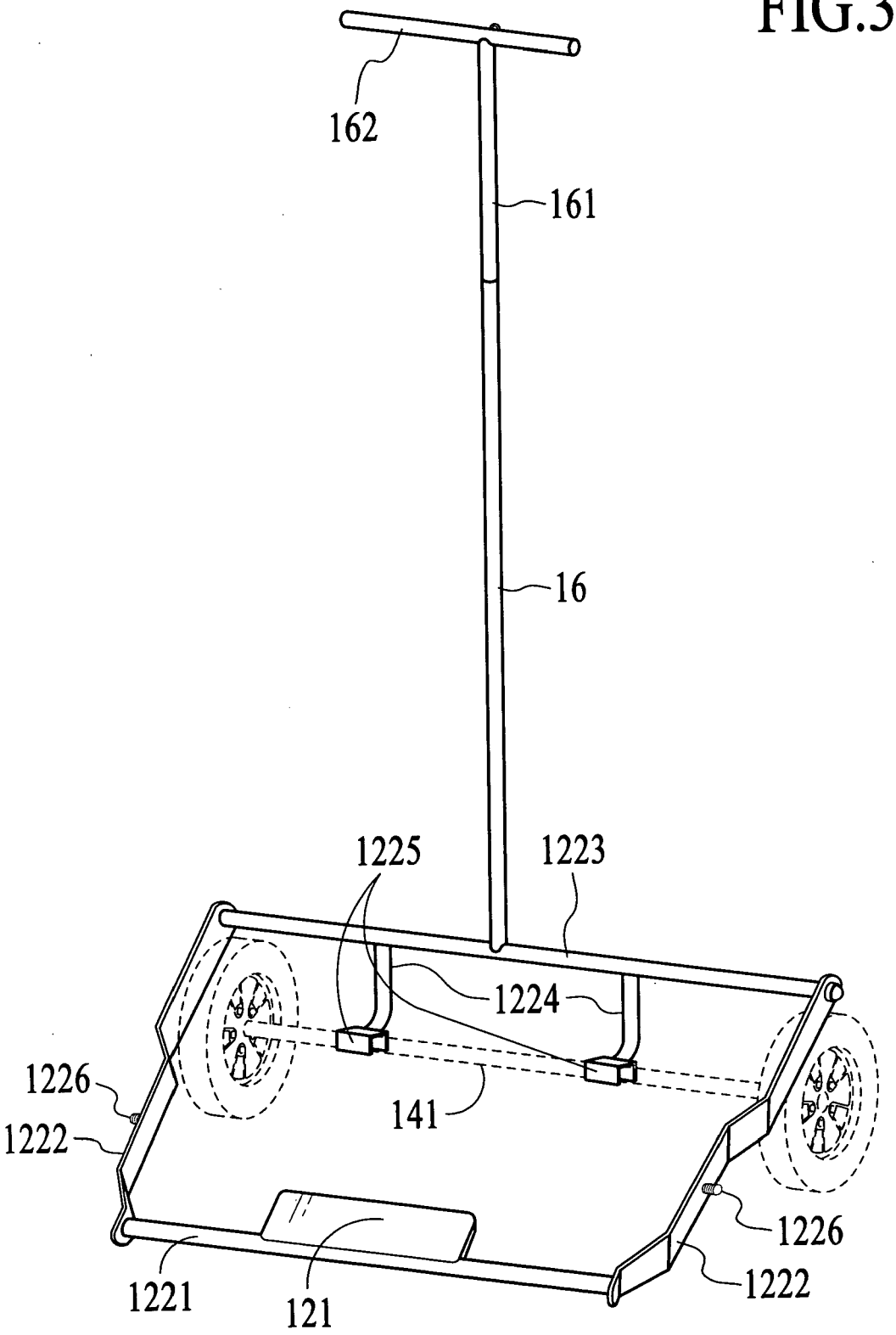
FIG. 3 is a perspective view of the lid opener itself, showing in phantom the axle of the barrel that is used for mounting the lid opener.

Referring first to FIGS. 1–3, the present invention is a hands-free trash barrel lid opener 10. The trash barrel lid opener 10 comprises an actuating mechanism 12 that is secured at the lower end of a trash barrel 14. The actuating mechanism comprises a foot pedal 121 and a mounting bracket 122.

The mounting bracket 122 comprises a front bar 1221, a pair of side bars 1222, and a rear bar 1223. The rear bar 1223 includes a pair of extenders 1224 that project downward and inward to reach the axle 141 of the trash barrel 14. Clamps 1225 at the end of the extenders 1224 secure the mounting bracket 122 to the axle 141. The clamps 1225 attach to the axle 141 with a friction fit only. This enables the mounting bracket 122 to be secured to the trash barrel 14 using no fastening means that penetrate any part of the barrel 14. The mounting bracket 122 further comprises a pair of lower cable lugs 1226 that protrude outwardly from the side bars 1222. It should be noted that while a flat bar construction is illustrated, the mounting bracket 122 can also be formed from round members.

An optional stabilizing t-bar 16 extends upward from the rear bar 1223 of the mounting bracket 122. The vertical member 161 of the t-bar 16 is sized to reach the underside of the lid 142 of the trash barrel 14. The horizontal member 162 of the t-bar 16 is received in a space on an underside of a top flange 143 of the trash barrel 14. The horizontal member 162 is sized to fit into a space between reinforcing ribs. Note that the horizontal member 162 must be positioned in front of a lid pivot axis 144.

Figure 4:
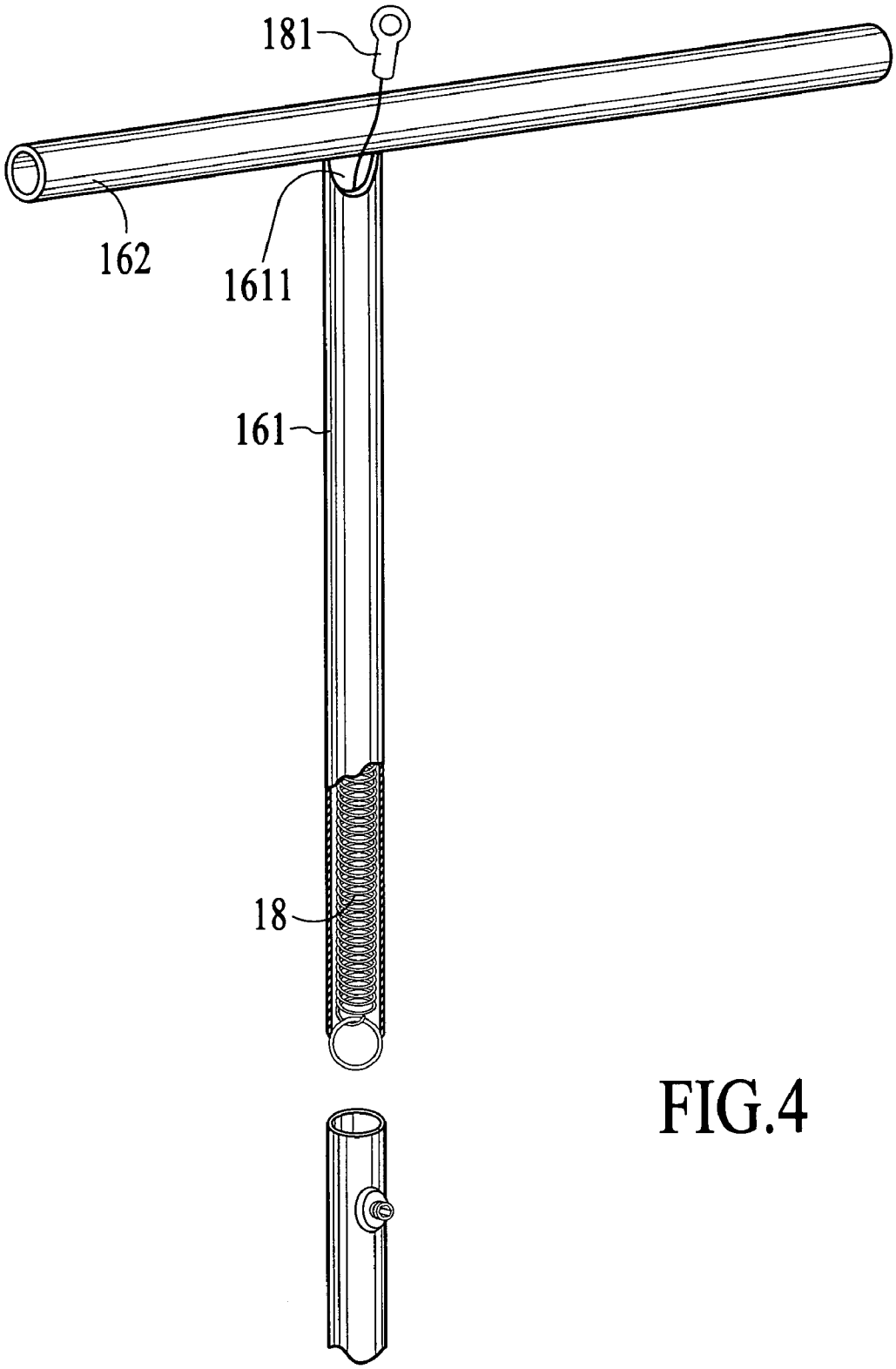
FIG. 4 is a partially broken view of the stabilizer bar with the counterbalance means therein.

Referring now to FIG. 4, the interior of the vertical member 161 is hollow in order to receive a counterbalance means 18. In the preferred embodiment, the counterbalance means 18 is a spring. The spring 18 is secured at a first end to the vertical member 161, and the second end of the spring 18 is affixed to a cable 181 that passes through an aperture 1611 at the top end of the vertical member 161. The cable 181 is then secured on a lid control mechanism 20.

Figure 5:
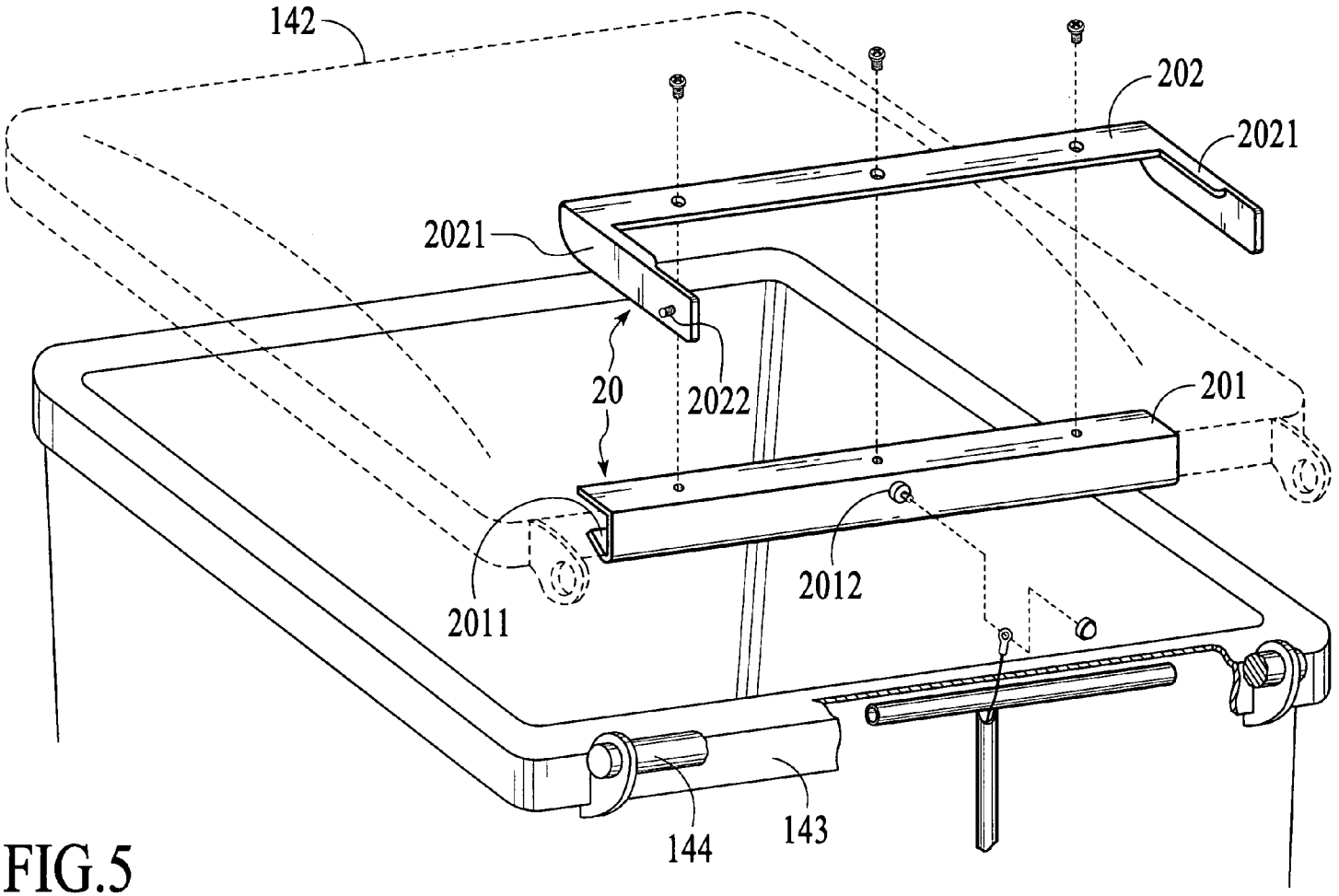
FIG. 5 is an exploded view of the lid control mechanism.

Referring now to FIG. 5, the lid control mechanism 20 comprises a three-sided securing base 201. The bottom side 2011 of the securing base 201 is angled upward to securely affix the lid control mechanism 20 to the lid 142 of the trash barrel 14. As with the mounting bracket 122, the angled bottom side 2011 affixes the securing base 201 to the lid 142 of the trash barrel 14 with a friction fit only. No fastening means that penetrate any part of the trash barrel 14 are used to secure either the lid control mechanism 20 or the mounting bracket 122.

A counterbalance anchor 2012 is mounted at a rear side of the securing base 201, and serves as the attachment point for the spring cable 181. The counterbalance anchor 2012 must be situated in front of the lid pivot axis 144.

A leverage arm plate 202 is secured to a top surface of the lid control mechanism securing base 201. The leverage arm plate 202 includes a pair of leverage arms 2021 that extend rearward from the lid 142. An upper cable lug 2022 extends from a rear portion of each leverage arm 2021. The upper cable lugs 2022 provide an anchor point for connecting cables 22 that run along the outside of the trash barrel 14. The connecting cables run from the lower cable lugs 1226 on the actuating mechanism 12 to the upper cable lugs 2022 on the lid control mechanism 20. Note that the upper cable lugs 2022 are well behind the lid pivot axis 144.

Operation of the hands-free trash barrel lid opener 10 begins when pressure is applied to the actuating mechanism 12, which is most easily accomplished by pressing on the foot pedal 121. As the actuating mechanism 12 moves downward, the connecting cables 22 pull downward on the leverage arms 2021. Since the upper cable lugs 2022 are situated well behind the lid pivot axis 144, the downward motion of the leverage arms 2021 causes the lid 142 of the trash barrel 14 to open so that the user can deposit items as desired.

As the lid 142 opens, tension on the counterbalance means 18 is increased as the spring is extended. When pressure on the foot pedal 121 is released, the tension in the counterbalance means 18 urges the lid 142 back to it closed position. Thus the user can open and close the lid 142 without touching the lid 142 with his hands.

The above disclosure is not intended as limiting. Those skilled in the art will recognize that numerous modifications and alterations may be made while retaining the teachings of the invention. Accordingly, the above disclosure should be construed as limited only by the restrictions of the appended claims.

We claim:

1. A hands-free trash barrel lid opener comprising:

an actuating mechanism, a lid control mechanism, and means to connect said actuating mechanism to said lid control mechanism; wherein said actuating mechanism comprises a mounting bracket with a front bar, a pair of side bars, and a rear bar, said rear bar including extenders with clamps at terminal ends thereof, said clamps serving to provide a friction fit attachment to an axle of a trash barrel, and said actuating mechanism and said lid control mechanism are mounted so that said trash barrel is moved and emptied with said hands-free trash barrel lid opener in position on said trash barrel.

2. The hands-free trash barrel lid opener as defined in claim 1 wherein:

said actuating mechanism and said lid control mechanism are mounted without the use of any fastening device that penetrates a part of said trash barrel.

3. The hands-free trash barrel lid opener as defined in claim 1 wherein:

said means to connect said actuating mechanism to said lid control mechanism is a cable.

4. The hands-free trash barrel lid opener as defined in claim 1 wherein: said actuating mechanism is mounted at a lower end of said trash barrel so that a user can operate said actuating mechanism with his foot.

5. The hands-free trash barrel lid opener as defined in claim 1 wherein:

said hands-free trash barrel lid opener further includes a stabilizing t-bar that extends along a back side of said trash barrel between said mounting bracket and a top flange of said trash barrel.

6. The hands-free trash barrel lid opener as defined in claim 1 wherein:

said hands-free trash barrel lid opener further includes a counterbalance means to urge a lid of said trash barrel toward a closed position.

7. The hands-free trash barrel lid opener as defined in claim 5 wherein:

said counterbalance means comprises a spring.

8. A hands-free trash barrel lid opener comprising:

an actuating mechanism, a lid control mechanism, and means to connect said actuating mechanism to said lid control mechanism; wherein said actuating mechanism comprises a mounting bracket with a front bar, a pair of side bars, and a rear bar, said rear bar including extenders with clamps at terminal ends thereof, said clamps serving to provide a friction fit attachment to an axle of a trash barrel, said actuating mechanism and said lid control mechanism are mounted so that a trash barrel is moved and emptied with said hands-free trash barrel lid opener in position on said trash barrel, and said actuating mechanism and said lid control mechanism are mounted without the use of any fastening device that penetrates a part of said trash barrel.

9. The hands-free trash barrel lid opener as defined in claim 8 wherein: said means to connect said actuating mechanism to said lid control mechanism is a cable.

10. The hands-free trash barrel lid opener as defined in claim 8 wherein:

said actuating mechanism is mounted at a lower end of said trash barrel so that a user can operate said actuating mechanism with his foot.

11. The hands-free trash barrel lid opener as defined in claim 8 wherein:

said hands-free trash barrel lid opener further includes a stabilizing t-bar that extends along a back side of said trash barrel between said mounting bracket and a top flange of said trash barrel.

12. The hands-free trash barrel lid opener as defined in claim 8 wherein:

said hands-free trash barrel lid opener further includes a counterbalance means to urge a lid of said trash barrel toward a closed position.

13. A hands-free trash barrel lid opener comprising:

an actuating mechanism, a lid control mechanism, a counterbalance means to urge a lid of a trash barrel toward a closed position, and means to connect said actuating mechanism to said lid control mechanism; wherein said actuating mechanism comprises a mounting bracket with a front bar, a pair of side bars, and a rear bar, said rear bar including extenders with clamps at terminal ends thereof, said clamps serving to provide a friction fit attachment to an axle of a trash barrel, and said actuating mechanism and said lid control mechanism are mounted so that said trash barrel is moved and emptied with said hands-free trash barrel lid opener in position on said trash barrel.

14. The hands-free trash barrel lid opener as defined in claim 13 wherein:

said means to connect said actuating mechanism to said lid control mechanism is a cable.

15. The hands-free trash barrel lid opener as defined in claim 13 wherein:

said actuating mechanism and said lid control mechanism are mounted without the use of any fastening device that penetrates a part of said trash barrel.

16. The hands-free trash barrel lid opener as defined in claim 13 wherein:

said actuating mechanism is mounted at a lower end of said trash barrel so that a user can operate said actuating mechanism with his foot.

17. The hands-free trash barrel lid opener as defined in claim 13 wherein: said hands-free trash barrel lid opener further includes a stabilizing t-bar that extends along a back side of said trash barrel between said mounting bracket and a top flange of said trash barrel.

* * * * *